United States Patent [19]

Lo Vullo et al.

[11] Patent Number: 4,465,560

[45] Date of Patent: Aug. 14, 1984

[54] METHOD AND DEVICE FOR PROTECTING THE ANODES OF ELECTROLYTIC CELLS AGAINST OVERLOADS, SHORT CIRCUITS AND UNBALANCES

[75] Inventors: Ferdinando Lo Vullo, Ronco Secondo; Emanuele Malvezzi, Siracusa; Primo Balboni, Frassine, all of Italy

[73] Assignee: Montedison S.p.A., Milan, Italy

[21] Appl. No.: 490,358

[22] Filed: May 2, 1983

[30] Foreign Application Priority Data

May 5, 1982 [IT] Italy ..... 21102 A/82

[51] Int. Cl.[3] ..... C25B 1/36; C25B 15/02; C25B 15/06

[52] U.S. Cl. ..... 204/1 R; 204/1 T; 204/99; 204/219; 204/225; 204/228; 204/400

[58] Field of Search ..... 204/228, 225, 219–220, 204/250, 99, 1 R, 1 T, 400

[56] References Cited

U.S. PATENT DOCUMENTS 3,723,285 3/1973 Daga et al. ..... 204/228

3,853,723 12/1974 Mack ..... 204/219 X 4,244,801 1/1981 Bergner et al. ..... 204/225

*Primary Examiner*—Donald R. Valentine

*Attorney, Agent, or Firm*—Stevens, Davis, Miller & Mosher

[57] ABSTRACT

A method for protection against overloads in mercury cathode electrolytic cells, consisting in detecting, in an indirect way, the average currents of the two semicells forming the cell to be protected by measuring the average of the anode potentials of the two semicells with respect to the two average potentials of the two semibottoms of the next cell, via a bridge circuit connecting said two average potentials of the semicells with said two average potentials of the semibottoms of the next cell, and in obtaining, with a balanced cell, two signals of bridge unbalance, by connecting in said bridge two double potentiometers having only one control, such as to actuate alarm devices when, because of overloaded anodes or of current unbalances, the value of one of said signals is zero. A device for carrying out this method consists of bridge electric circuits, with a double potentiometer for working out signals, as well as contact-connected alarm thresholds for setting in action alarm and/or anode-lifting devices.

5 Claims, 5 Drawing Figures

Figure 4:
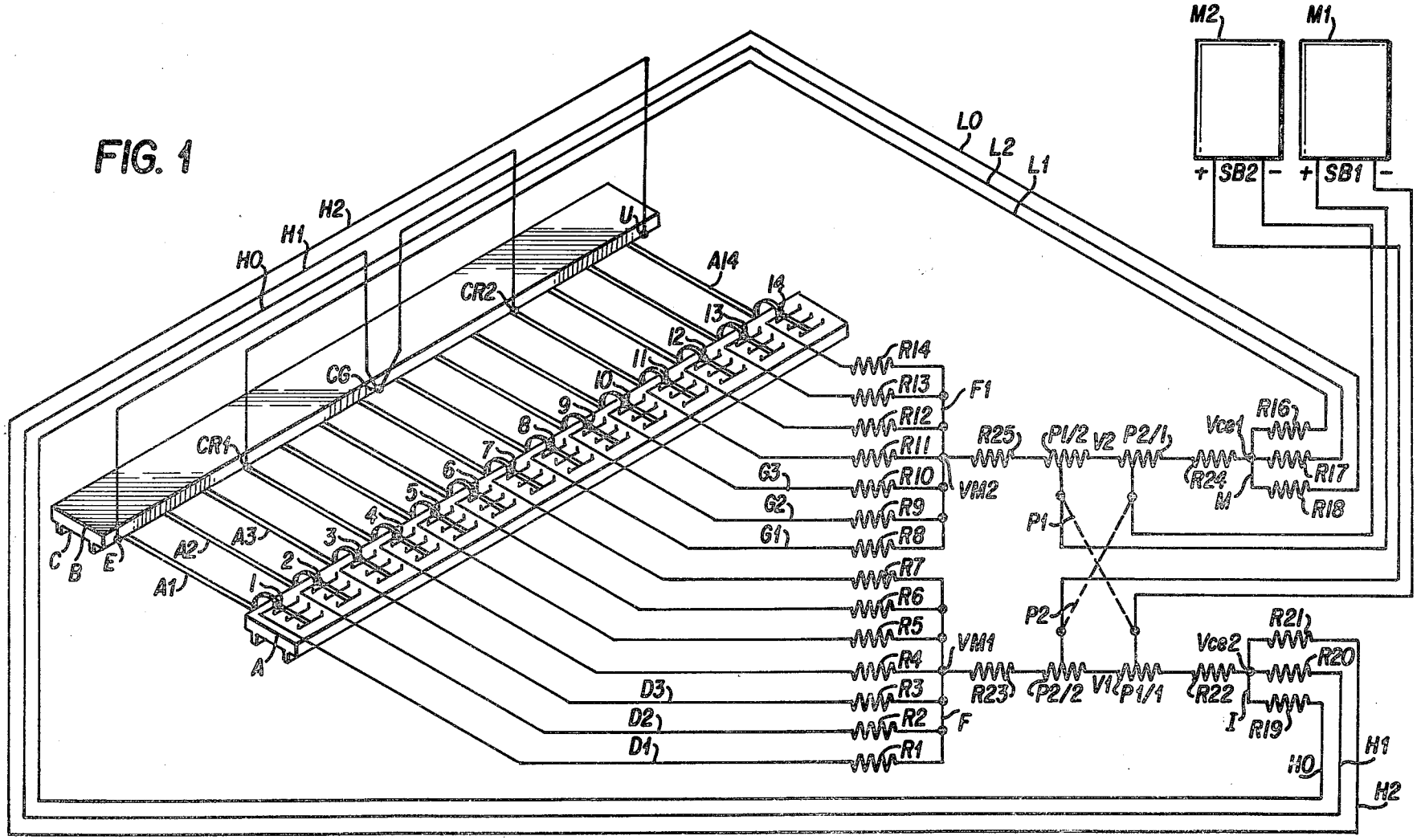

METHOD AND DEVICE FOR PROTECTING THE ANODES OF ELECTROLYTIC CELLS AGAINST OVERLOADS, SHORT CIRCUITS AND UNBALANCES

The present invention relates to a method for protecting the anodes of the electrolytic cells against electrical overloads of any origin and, more precisely, for protecting the anodes of mercury cathode electrolytic cells for the production of chlorine. The invention relates also to an electric device for carrying out said protection method.

It is known that the mercury cathode electrolytic cells consist of tanks having a slanting bottom over which the brine with mercury flows and at the top of which a number of frames are placed, which support a set of anodes and are moved vertically in order to adjust the intervals or spacing between the cathodic mercury and such anodes. Generally, the cells are connected in series with each other, are supplied with direct current at low voltage and at high current intensity, and the current is conveyed to the anodes of the various cells by means of upwardly extending metal bars interposed between the bottom of a cell and the anodes of the subsequent cell, sometimes called anode ascents or anode ascent bars. It is also known that to obtain good efficiencies the intervals or spacing between the cathodic mercury surface and the anode surface must be very small (e.g., a few millimeters). Therefore, owing to any unevenness or change of the anode surface or of the mercury surface, overloads or short circuits can occur between the anodes and the cathode, with consequent decrease of the efficiencies and dangerous, and sometimes even disruptive, damage to a plant.

There have already been proposed several protection devices that sometimes are very complicated and expensive, which operate automatically in case of current overloads in the anodes, giving rise to the lifting of such anodes or to stopping the supply of electricity. Generally, these devices are based on the detection of the single currents of anodic ascent, but sometimes, and especially in consequence of small load values in the plant, such devices do not always operate, or if they do, they do not always operate at the right time.

Other known, very complicated and expensive devices are based on the detection and amplification of a plurality of bar currents, by means of which said devices carry out the discrimination of the current having the highest intensity, in order to compare then this current with a quantity of electricity that depends on one or more of said plurality of anodic currents. For instance, see the Daga et al U.S. Pat. No. 3,723,285. Generally, these devices, although they give a certain degree of assurance under any condition of cell load, require the measurement and the amplification of all the anodic currents and are in practice complicated, voluminous, and above all, so expensive, as to prevent their practical general employment.

The main object of this invention is to provide a protection method effective against overloads in electrolytic cells, as well as a device for the practical carrying out thereof, such as to obviate the drawbacks and restrictions of the known methods and devices; i.e., such a method and such a device must be able to protect the anodes in a simple, safe and sensitive way, at small loads as well as large.

Another object of this invention is to provide an anode protection device that is able to operate, and therefore to prevent short circuits between the electrodes owing to unbalances due to any electrical or mechanical cause of the currents of the anodic ascent bars, with the same timeliness and sensitivity at any load value of the cell room.

A further object of this invention is to allow the emission of signals which, besides acting in acoustic or luminous alarm devices, may be utilized for the direct control of lifting motors for the set of anodes or may also be sent to a programmed computer, in order to signal, for any load of the cells, whether the detected signals are due to real current unbalances between the anodes or to mechanical anomalies in the electrical circuit between such anodes and the protection device, with undeniable advantages for singling out the kind of anomalies and for the rapidity of response, besides the saving in energy.

These objects, as well as others, which will appear evident from the detailed following description, are in practice achieved by a protection method against overloads in electrolytic cells, and, in particular, in mercury cathode electrolytic cells which are connected in series with each other through anodic ascent bars and are provided with a set of anodes supported by moving frames. This method, according to the present invention, consists or consists essentially of:

indirectly detecting the average currents of the two semicells forming the cell to be protected, by measuring the potential difference of the anodes of both semicells with respect to the bottom of the next cell, preferably the preceding one, in order to obtain two signals or average voltages equal to each other when the cell is in balance, and different from each other when the cell is not in balance; in this last case, the value of the difference between said two signals depends on the magnitude of overload;

measuring the two average potentials of the semibottoms of said next cell, the difference of which corresponds exactly to the part of the difference between said average voltages, which is only due to the position of the overloaded anode; then eliminating or compensating said bottom voltages of the next cell by bridge-connecting said average voltages of the two semicells with said two average potentials of cell bottom, applied in an inverted way, in order to obtain two voltages, which depend only on the current unbalance of the two semicells; then obtaining two unbalance signals of the mesurement bridge, depending on the cell load, by connecting in said bridge a potentiometric device having a double measuring system, calibrated according to values different from zero, so that, when the cell is balanced, said two unbalance signals assume negative increasing values and are such as to actuate alarm devices, or to set in action the anode-lifting means, when the value of one of said signals is zero, i.e., when a semicell overloads, with respect to the other, of the percentage corresponding to the pre-established calibration value on said potentiometric device.

More particularly, the falls in ascent bar voltage, measured with respect to the bottom of the next cell, correspond to the currents, since the resistances of the copper bar may be considered as constant. Since, however, a variation of about 0.5% on the average anodic potential of a semicell corresponds to a temperature variation of 10° C. of a bar with respect to the others, the influence of the possible resistance variations due to the different temperatures can be considered as unimportant because the system is calibrated for a difference of about 10% between the two unbalance signals.

To carry out the protection method of the present invention, a connection and measurement device is provided between the anodes of a cell and the bottom of the next cell, such device comprising, according to the invention, a first set of electric cables, each of them having an end connected with the anodic ascent bars of the anodes of a semicell and the opposite end connected, through a resistance, with a common wire on which a first average voltage is available, corresponding to the current flowing in the anodes; a second set of cables connecting, always through resistances, the anodes of the second semicell with a second common wire on which a second average voltage is available; further cables connected with an end to the semibottom of the next cell and with the opposite ends, always through resistance, to a joining wire on which a first bottom voltage of the next cell is available; further cables still connected with the other semibottom of the next cell and joined at the opposite end in order to render available a second voltage of cell bottom; a bridge connection having an arm, relating to the first semicell, supplied by said first average voltage and by said second voltage of cell bottom, and the second arm, relating to the second semicell, supplied by said second voltage and by said first voltage of cell bottom, in order to have, between the two central points of the two arms, voltage differences which only depend on the unbalance size of the currents of the two semicells; two double response potentiometers, with a single control, connected in the arms of said bridge and calibrated in such a way that the unbalance signals detected on said two potentiometers shall be, when the cell is balanced, different from zero and as such to assume values which are negative increasing and proportional to the load, so as to allow the response of the device to set to zero one of said two unbalance signals in correspondence to an overload percentage of a semicell, with respect to the other, equal to the pre-established calibration value; said unbalance signals of the measurement bridge being sent to two alarm thresholds, the response of which provides one or more contacts capable to set in action acoustic or luminous signals or the motors for the anode-lifting, with a pre-established lag, both at the response and at the recovery.

Figure 2:
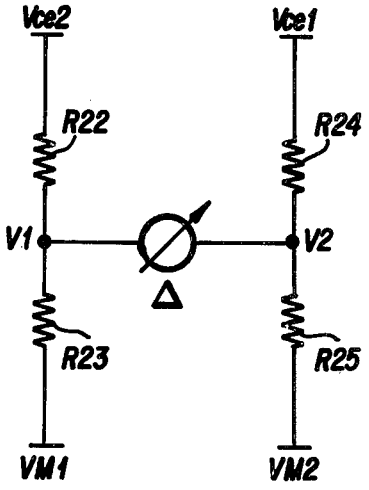
Figure 3:
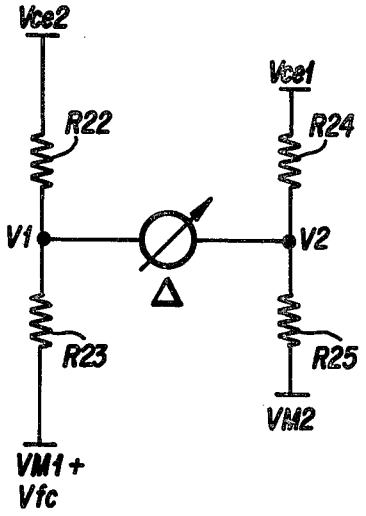
Figure 4:
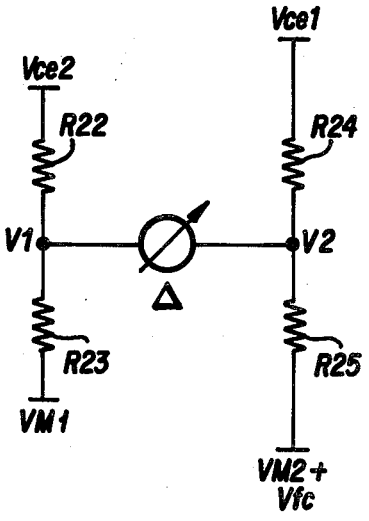
Figure 5:
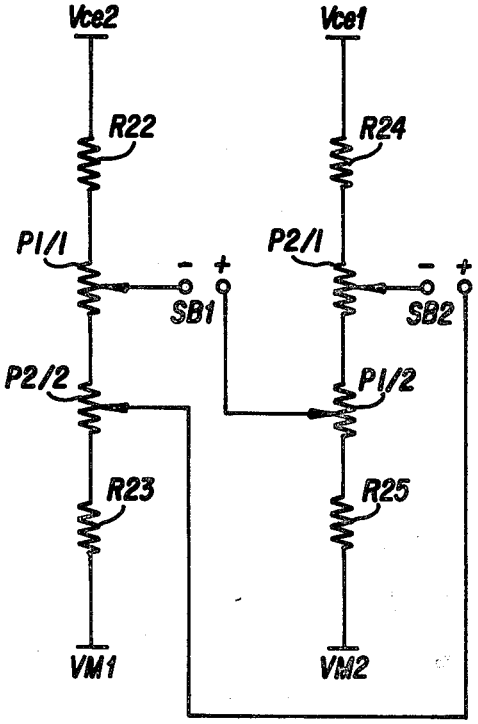

This invention will be described in still greater detail hereafter, with reference to the accompanying drawings, which are given only for illustrative but not limitative purposes, and in which:

FIG. 1 shows the block diagram of the protection device, according to the invention, and its electric connection at two adjacent cells;

FIGS. 2, 3 and 4 show graphically the levels of the electric potentials, respectively, in the following situations: balanced cell, unbalanced cell with first semicell overloaded, and unbalanced cell with second semicell overloaded; and FIG. 5 shows a diagram of a processing device of the unbalance signals of the measuring bridge in dependence on the load, which can be obtained by means of the method and device.

With reference to such figures, and particularly to FIG. 1, the protection device is applied to a cell A having 14 anodes, indicated by the numbers from 1 to 14; cell A, as known, is supplied from the preceding cell B through the anodic ascent bars indicated by $A_1$, $A_2$, $A_3$, etc., which connect bottom C of the preceding cell B with the upper end of anodes 1–14. The protection device consists substantially of a first group of seven wires D1, D2, D3, etc., connected with an end to the anodes from 1 to 7 and with the opposite end to seven resistances R1–R7, the output of which is joined in a single wire F, from which a voltage VM1 can be drawn. Likewise, for the second semicell comprising the anodes from 8 to 14, wires G1, G2, G3, etc. are employed, which, at the free end, are connected—always through resistances from R8 to R14—with a single wire F1, from which the average voltage VM2 can be drawn.

To carry out the process, the device comprises, furthermore, a cable HO connected in the middle CG of bottom C of the preceding cell B, a cable H1 connected in point CR2 of bottom C of the preceding second semicell B, and a cable H2 connected at the output end U of cell B. These three cables are joined, through resistances R19, R20 and R21, to a single wire I, on which a voltage is available, as indicated in FIG. 1 by Vce2; likewise, cables L0, L1 and L2 and relevant resistances R16, R17, R18 are set up on the first semicell B and said cables join to the single wire M, on which a voltage Vce1 is available; the values and the function of the anodic voltages of the two semicells to be tested and of the semicells to be compared, i.e., of VM1, VM2 and, respectively, Vce2 and Vce1, will be hereinafter explained.

The arrangement and the type of equipment suitable for the processing of the unbalance signals and for the control of the alarm devices, as shown in detail in FIGS. 2 to 5, will also be hereinafter explained.

As already said above, the device prevents short circuits between anode and cathode, since it operates when unbalances of the anodic currents arise, with the same rapidity and sensitivity for any load value of the cell room; therefore, the device bases its response on data relating to the distribution of the currents.

Should the cell be in balance, the fourteen anodic currents (FIG. 1) are obviously all equal to each other, and, therefore, potentials VM1 and VM2 will be equal to each other as well. Should cell A under examination be unbalanced, the average of the semicell currents with one or more overloaded anodes increases, and the value of such increase, as known, is equal to the average decrease of currents of the other semicell. This happens, because the anode that is the nearest to the mercury cathode, i.e., the overloaded anode, draws also current from the furthest anodes which are relevant to both the semicells. In other words, the fourteen currents of cell A under examination, when the cell is unbalanced, change value, but their sum, that corresponds to the electrical load of the cell room, remains constant.

Therefore, the protection device detects and utilizes the average currents of the two semicells forming cell A and operates, when the signal, emitted by a semicell, increases with respect to the one emitted by the other semicell by a pre-established percentage.

For simplicity's sake concering the carrying out and the processing of the signals, the currents of each anode, according to the invention, are detected in an indirect way, by measuring the potential difference of each anode of cell A with respect to bottom C of the preceding cell B. In fact, the bar voltage falls and their average (VM1 and VM2) detected in such a way, correspond to the currents flowing respectively through the anodes from 1 to 7 and the anodes from 8 to 14 (FIG. 1), since the resistances of the copper bar may be considered as constant.

As a matter of fact, there are voltage variations due to the different temperatures of each bar with respect to the others but, since every difference of 10° C. of temperature inserts on every single current measurement an error of about 4%, such error becomes uninfluential (about 0.5%) if we consider that the two average voltage values VM1 and VM2 are obtained by the average of seven measurements for each semicell and that the system response can be calibrated in such a way that it can operate only for a pre-established difference between said two signals VM1 and VM2, and such difference is, for example, 10%.

Under balance conditions, bottom C of the preceding cell B is equipotential, while, in the presence of unbalance, the current flows through the bottom and every point of said bottom assumes its own potential, which depends on the magnitude of the overload. Consequently, the average bar potentials falls (VM1 and VM2) result in being equal to each other, when the cell is in balance, while, when the cell is unbalanced, one has: $VM1-VM2=\pm\Delta+Vfc$, where $\Delta$ is the difference between the two potentials, depending on the magnitude of overload of a semicell with respect to the other semicell, and Vfc is the difference between the two average potentials Vce1 and Vce2 of the two semibottoms of the preceding cell B, i.e., $Vfc=Vce1-Vce2$.

To render the average voltage measurements VM1 and VM2 independent of the influence of the bottom unbalances of the preceding cell, it is necessary to compensate for the Vfc values in order to render them uninfluential.

To this purpose, a particular bridge (FIGS. 2-3-4 and FIG. 1) is provided, wherein the arm relevant to the first semicell (anodes from 1 to 7) is supplied by values VM1 and Vce2 and the arm relevant to the second semicell is supplied by VM2 and Vce1, with interposition of two resistances, i.e., R23 and R22 in the first arm and R25-R24 in the second arm. This bridge provides for reversal of the average potentials of the preceding cell bottom, i.e., the application of Vce2 in connection with VM1 and of Vce1 in connection with VM2. The reversal of the two average potentials Vce1 and Vce2 allows one to obtain a difference, $\Delta$, between the two central points V1 and V2 of the two bridge arms, which depends only on the magnitude of unbalance of the currents flowing in the anodes of the two semicells under consideration.

When the cell is in balance, the bridge of FIG. 2 allows one to obtain a value of $\Delta$ and of Vfc, which are both equal to zero; in fact, since in this case $Vce1=-Vce2$, their difference is equal to zero, as well as, since VM1 is equal to VM2, their difference being equal to zero too.

On the contrary, when the first semicell is overloaded (FIG. 3), one has:

$$V1=\frac{VM1+Vfc}{2}=\frac{VM1}{2}+\frac{Vfc}{2};$$

$$V2=\frac{VM2-Vfc}{2}+Vfc=\frac{VM2}{2}+\frac{Vfc}{2},$$

from which, by simple conversion, one obtains: $\Delta_1=V1-V2=(VM1/2)-(VM2/2)$.

Likewise, for the second overloaded semicell (FIG. 4), by operating as for the first semicell, one obtains a value of $$\Delta_2=V2-V1=(VM2/2)-(VM1/2).$$

That is to say, both values of $\Delta_1$ and $\Delta_2$ are independent of Vfc.

To make easier the following description from now on, unbalance signals $\Delta_1=V1-V2$ will be indicated by SB1, while signal $\Delta_2=V2-V1$ will be indicated by SB2.

In practice, the difference, $\Delta$, between values V1 and V2 for the same size of cell unbalance, assumes different values, depending on the total load of the cell room. To obtain the response of an alarm or control device at the same percentage of the current unbalance independently of the load value of the cell room, two double potentiometers P1-P2 having a single control are connected in the electric circuit of the bridge (FIG. 5 and FIG. 1). Both measuring elements (resistances) P1/1 and P1/2 of the potentiometer indicated by P1 are connected on the bridge: one on the first arm of the bridge, the other on the second one. Likewise, both measuring elements P2/1 and P2/2 of potentiometer P2 are connected on the bridge: one on the second arm of the bridge and the other on the first one, as clearly shown in FIG. 5 and in FIG. 1.

From the central points of resistances P1/1-P1/2 and P2/1-P2/2, respectively, one obtains the unbalance signals SB1 and, respectively, SB2, processed as above described.

To render the device operational and to realize an automatic pursuit or detection of the calibration point by varying the electric load, the two signals SB1 and SB2 are pre-established, when the cell is in balance, by determining on the potentiometers values equal to each other but different from zero. By operating in such a way, signals SB1 and SB2 assume, when the cell is in balance, negative increasing values and proportional to the load.

The protection device operates when one of the two signals (SB1 and SB2) is reduced to zero, which happens, when a semicell is overloaded with respect to the other, by the percentage corresponding to the value set on the potentiometers.

The relations hereinafter recorded confirm the above statements. Indicating by $K_1$ and $K_2$ the calibration percentages of the overload, relevant respectively to the first and the second semicell, one obtains, for signals SB1 and SB2, as follows:

Cell in balance $$VM1=VM2=VM;$$

$$SB1=\left(\frac{VM1}{2}-\frac{VM1}{2}K_1\right)-\left(\frac{VM2}{2}+\frac{VM2}{2}K_1\right)$$

$$=\frac{VM}{2}-\frac{VM}{2}K_1-\frac{VM}{2}-\frac{VM}{2}K_1=-VMK_1$$

$$SB2=\left(\frac{VM2}{2}-\frac{VM2}{2}K_2\right)-\left(\frac{VM1}{2}+\frac{VM1}{2}K_2\right)$$

$$=\frac{VM}{2}-\frac{VM}{2}K_2-\frac{VM}{2}-\frac{VM}{2}K_2=-VMK_2$$

Assuming that the values of $K_1$ are equal to the values of $K_2$, signals SB1 and SB2 will equal to each other.

Overload in the first semicell

The device operates when signal SB1=0, i.e., when the overload in the first semicell (calculated likewise as for cell in balance), assumes the value $(VM1/2)=(VM2/2)+VMK_1$, where $VM=(VM1+VM2)/2$.

At the response of the device, while SB1 reaches value zero, signal SB2 (unbalance of the second semicell) assumes the value $-2\ VMK_2$.

Overload in the second semicell

By developing the expressions in the manner shown previously, SB2 will reach the condition of zero setting when $(VM2/2)=(VM1/2)+VMK_2$; in this case the unbalance signal of the first semicell will become $SB1=2VMK_1$.

The unbalance signal of measurement bridges SB1 and SB2 are sent to amplification and conversion equipments, as indicated by M1 and M2 in FIG. 1, and from here to two alarm thresholds of known type and not shown in the figure, having an excursion range comprised, for example, among −25 and +5 mV. When a current unbalance arises in the cell, i.e., when one of signals SB1 and SB2 becomes 0 mV, the corresponding threshold operates by supplying a contact, which immediately activates, for example, the anode-lifting means, and after a short time (for example, 15 seconds), if the anomaly has not disappeared, it cuts out the cell by means of an external timer.

The contact of the alarm thresholds presents an internal lag of a few seconds, either at the response, as well as at the recovery. The first lag serves to eliminate untimely operations due, for example, to temporary unbalances caused by connections or disconnections of adjacent cells or by short fluctuation of the mercury surface. The lag at recovery serves to activate the anode-lifting motors to bring the cell well outside the unbalance zone.

Furthermore, the value of internal calibration of a threshold (for example, the one connected with signal SB1) is fixed at +0.2 mV, to avoid the device response when the cell is not working or in the starting phase, i.e., when the signals SB1 and SB2 equal zero mV.

Finally, according to this invention, the above-described protection device can be advantageously utilized also to detect possible anomalies which are not associated with current unbalances inside the cell, as, for example, current unbalances due to mechanical causes, such as imperfect wire connections, defects in the terminal clamping, and the like.

To obtain such a signaling, the unbalance signals of bridges SB1 and SB2 are sent to a computer that has been previously set in such a way as to allow the alarm thresholds to operate only when the algebraic sum of the two signal variations corresponds, at various cell loads, to the set or predetermined value. This means that the unbalance of a semicell corresponds to the unbalance of opposite sign in the other semicell. Such a computer will have been previously set in such a way as to signal, by means of a different alarm, for example, luminous or sounding, when such algebraic sum of the input signal variations does not correspond to the set value. In this case, it becomes immediately evident that the anomaly is not due to current unbalances among the anodes but to other causes. This, in practice, makes it easier to single out the failures and shortens the time for the recovery.

What is claimed is:

1. A method for the automatic protection against overloads of anodes placed in electrolytic cells, particularly in mercury cathode cells, in which the single cells are connected in series through anodic ascent bars and provided with a set of anodes supported by moving frames or the like, characterized in that it comprises:

indirectly detecting the average currents of two semicells forming the cell to be protected, by measuring the potential difference of the anodes of both the two semicells with respect to the bottom of the next cell, preferably the preceding one, in order to obtain two signals or average voltages, equal to each other when the cell is in balance, and different from each other when the cell is not in balance, in this last case the difference value between said two signals being dependent on the magnitude of the overload;

measuring the two average potentials of the semi-bottoms of said next cell, the difference between which exactly corresponds to the part of the difference between said avarage voltages which is due only to the position of the overloaded anode; then eliminating or compensating said bottom voltages of the next cell by bridge-connecting said average voltages of the two semicells with said two average potentials of cell bottom, applied in an inverted way, in order to obtain two voltages which depend only on the current unbalance of the two semicells; then obtaining two unbalance signals, depending on the cell loads, by connecting in said bridge a potentiometric device with double measuring elements, calibrated according to values different from zero, so that, when the cell is in balance, said two unbalance signals assume negative increasing values, such as to actuate alarm devices or to operate anode-lifting means, when the value of one of said signals is zero, i.e., when a semicell overloads, with respect to the other, by the percentage corresponding to the pre-established calibration value on said potentiometric device.

2. A method according to claim 1, characterized in that said two unbalance signals are sent to a computer programmed with an intervention value adapted to actuate said alarm devices only when the algebraic sum of the two signal variations, for each cell load, corresponds to said intervention value, and wherein further signals at the computer output are provided to operate separate alarms when said algebraic sum of the signal variations does not correspond to said intervention value.

3. A device for carrying out the method of claim 1, characterized in that it comprises:

a first set of electric cables, each of them having an end connected with the anodic ascent bars of the anodes of a semicell and the opposite end connected, through resistances, with a single wire on which a first average voltage is available corresponding to the current average of the respective anodes;

a second set of cables connecting the anodes of the second semicell with a wire on which a second average voltage is available;

further cables connecting, through resistances, the semibottom of the next cell with a connecting wire on which a first voltage of next cell bottom is available;

further cables connected with the other semibottom of the next cell and joined together, through resistances, to the opposite end in order to render available a second voltage of cell bottom;

a bridge connection having an arm, relevant to the first semicell, supplied by said first average voltage and by said second voltage of cell bottom, and a second arm, relevant to the second semicell, supplied by said second average voltage and by said first voltage of cell bottom, in order to obtain, between the two central points of the two arms, voltage differences which are dependent only on the magnitude of unbalance of the currents of the two semicells;

two double response potentiometers, having a single control, connected in the arms of said bridge and calibrated in such a way that the unbalance signals of the measurement bridge, detected on said two potentiometers, shall be, when the cell is in balance, different from zero and such as to assume values which are negative increasing and proportional to the load, so as to allow the response of the device for the reduction to zero of one of said two unbalance signals, corresponding to an overload percentage of a semicell, with respect to the other, equal to the pre-established calibration value, said unbalance signals being connected with two alarm thresholds, the response of which provides one or more contacts suitable to actuate acoustic or luminous alarms or the motors for anode-lifting.

4. A device according to claim 3, characterized in that said two alarm thresholds present a response range preferably between −25 and +5 mV, and in that an electric contact of delayed response is connected with said thresholds through an external timer, such as to cut out the cell only if the anomaly has not disappeared within a few seconds.

5. A device according to claim 3, characterized in that at least one of said thresholds presents an internal calibration value of a few tenths of millivolts, preferably about +0.2 mV, in order to prevent the device from operating when the cell does not work or where it is in the starting phase.

* * * * *